US005865717A

United States Patent [19]

Fabel

[11] Patent Number: 5,865,717

[45] Date of Patent: Feb. 2, 1999

[54] MAILING FORM FOR NON-IMPACT PRINTING

[75] Inventor: Warren M. Fabel, Delray Beach, Fla.

[73] Assignee: Laser Substrates, Inc., Boca Raton, Fla.

[21] Appl. No.: 480,161

[22] Filed: Jun. 7, 1995

Related U.S. Application Data

[62] Division of Ser. No. 240,869, May 10, 1994.

[51] Int. Cl.[6] ..... B65D 27/06

[52] U.S. Cl. ..... 493/216; 493/222

[58] Field of Search ..... 493/187, 188, 493/216, 222, 225, 228, 224, 233, 244, 264, 335

[56] References Cited

U.S. PATENT DOCUMENTS

| | | | |
|---|---|---|---|
| 3,941,308 | 3/1976 | DiGirolomo et al. | 493/216 |
| 4,543,082 | 9/1985 | Stenner | 493/222 |

*Primary Examiner*—Joseph J. Hail, III
*Assistant Examiner*—Anthony Ojini
*Attorney, Agent, or Firm*—Quarles & Brady

[57] ABSTRACT

A mailing form, including an upper sheet of material adhesively fastened to a lower sheet, is configured for the printing of information on a single side during passage of the form through a non-impact printer. At a first end of the form, the upper and lower sheets are fastened together permanently, forming a pocket to be used as a return envelope. The portion of the upper sheet which extends away from this pocket is divided into an inner flap, on which information is printed, and an outer flap, which is temporarily fastened to the lower sheet in order to protect an adhesive pattern during the printing process. After the printing process, the outer flap is removed and discarded, the inner flap is folded along lines provided for folding, and the lower sheet is folded on itself to enclose the inner flap. As the adhesive pattern holds the lower sheet shut in this position, address and return address information printed on the inner flap is visible through apertures in the lower sheet, which forms an envelope. After receiving this envelope, the recipient separates the pocket forming a return envelope from the rest of the materials. A part of the inner flap may be returned in this return envelope, together with a check or other remittance as desired. The address and return address has been printed on this envelope during the printing step. Before the return envelope is mailed it is sealed using a flap with remoistenable adhesive.

14 Claims, 5 Drawing Sheets

MAILING FORM FOR NON-IMPACT PRINTING

RELATION TO OTHER APPLICATIONS

This is a division of Ser. No. 08/240,869, Filed May 10, 1994.

BACKGROUND OF THE INVENTION

Field of the Invention

This invention relates to mailing forms, and more particularly, to mailing forms which can be folded into initial envelopes after information is printed with a non-impact printer.

Background Information

Non-impact printers, such as laser or ink jet printers, are being increasingly used to provide a fast, economical, and convenient method of printing data developed within computer systems and stored in databases. An important example of this kind of data is found in the accounts receivable data of both large and small organizations. In most organizations, preparing and distributing monthly statements represents a significant effort, as account data is printed and distributed in envelopes.

Many invoices, monthly statements, renewal notices, questionnaires and the like arrive in a single envelope together with a number of other printed documents. At a typical minimum level, a return envelope and a response document are included with the mailing. While responses may all be returned to a central location, it is often desirable to provide a number of different locations, or box numbers, to which responses for various different mailings are sent. In this way, an initial sorting step can be avoided.

Multi-part forms including envelopes in which statements are sent, together with the statements themselves, have been manufactured for use in impact printers. Such forms are typically assembled into webs with sprocket holes extending along one or both lateral edges to facilitate handling through a pin feed impact printer. Transferable coatings are selectively placed on one or more of the sheets making up the assembly, so that externally applied printing forces are transferred to produce characters on intermediate document surfaces. This approach has further been modified to provide a remittance envelope, in which various materials, such as a check and a portion of the statement, may be returned to the organization sending the statement.

However, with the increasing popularity of non-impact printers, especially with small organizations, the percentage of organizations having the impact printers necessary to use such multi-part forms is decreasing. Therefore, what is needed is a mailing form configured for use with non-impact printers, providing the capabilities of achieved through the use of mailing forms developed for impact printers.

Some mailing forms have in fact been developed for use with non-impact printers. However, such forms do not have the flexibility and capability of forms developed for use with impact printers. Furthermore, such forms often must be processed through automatic folding/sealing machines to be used in a prac/tical manner. Such automatic folding machines are other examples of equipment not available to many small organizations. Therefore, what is needed is a mailing form which can be easily prepared without the use of a folding machine.

Mailing forms developed for use in non-impact printers, require that some information be printed on each side of the form if a return envelope is to be constructed from the form. Because of practical considerations, dual side printing generally means that fixed data, which is the same for all of the forms being printed, must be printed on one side while variable data, which is generally specific for each form being printed, is printed on the other side. For example, the front of the return envelope is printed with fixed data on one side of the form. In this way, the customer returning the return envelope is required to fill out his return address. This compromise may present an inconvenience for the organization originally sending the mailing forms as well as for the customer. If the address of the organization must be printed as part of the fixed information on the return envelope, a special box number related to the particular form cannot be used. Thus, what is needed is a mailing form that can be used to produce an initial envelope, a return envelope, and a statement by printing on one side only of the form.

A number of different types of forms include flaps or pockets provided in a closed configuration which must be opened at a later time. Various means are employed to make a portion of the form tear open in a preferred manner. For example, a perforated or die cut sheet may be used in this way. Alternately or additionally, a number of parallel glass fibers (fiberglass) may be provided to give a particular strip of material the strength needed for easy removal without breaking apart. A problem with this approach is that the glass fibers lie only in a straight line, so that the material to be removed must be a straight strip. What is needed is a reinforcing coating which can be applied to material which is not straight, allowing its removal without breaking up.

SUMMARY OF THE INVENTION

In accordance with one aspect of the invention, there is provided a mailing form including a lower sheet of material having first and second ends, with a first transverse folding line between the first and second ends, and an upper sheet of material overlying and aligned with the lower sheet of material. The upper sheet of material includes a first upper sheet portion, an outer flap, and an inner flap, the outer flap and the inner flap being separated by a first cut line, and the outer flap extending to the second end of the lower sheet. A first adhesive system forms a bond between the first end and an adjacent surface of the first upper sheet portion and a second adhesive system forming a temporary bond between the second end and the outer flap. The second adhesive system includes an adhesive permanently bonded to the lower sheet, the second adhesive system being of a type which forms a permanent bond with another sheet of material after separation from the outer flap.

BRIEF DESCRIPTION OF THE DRAWINGS

One preferred embodiment of the subject invention is hereafter described with specific reference being made to the following Figures, in which.

DETAILED DESCRIPTION

Figure 1:
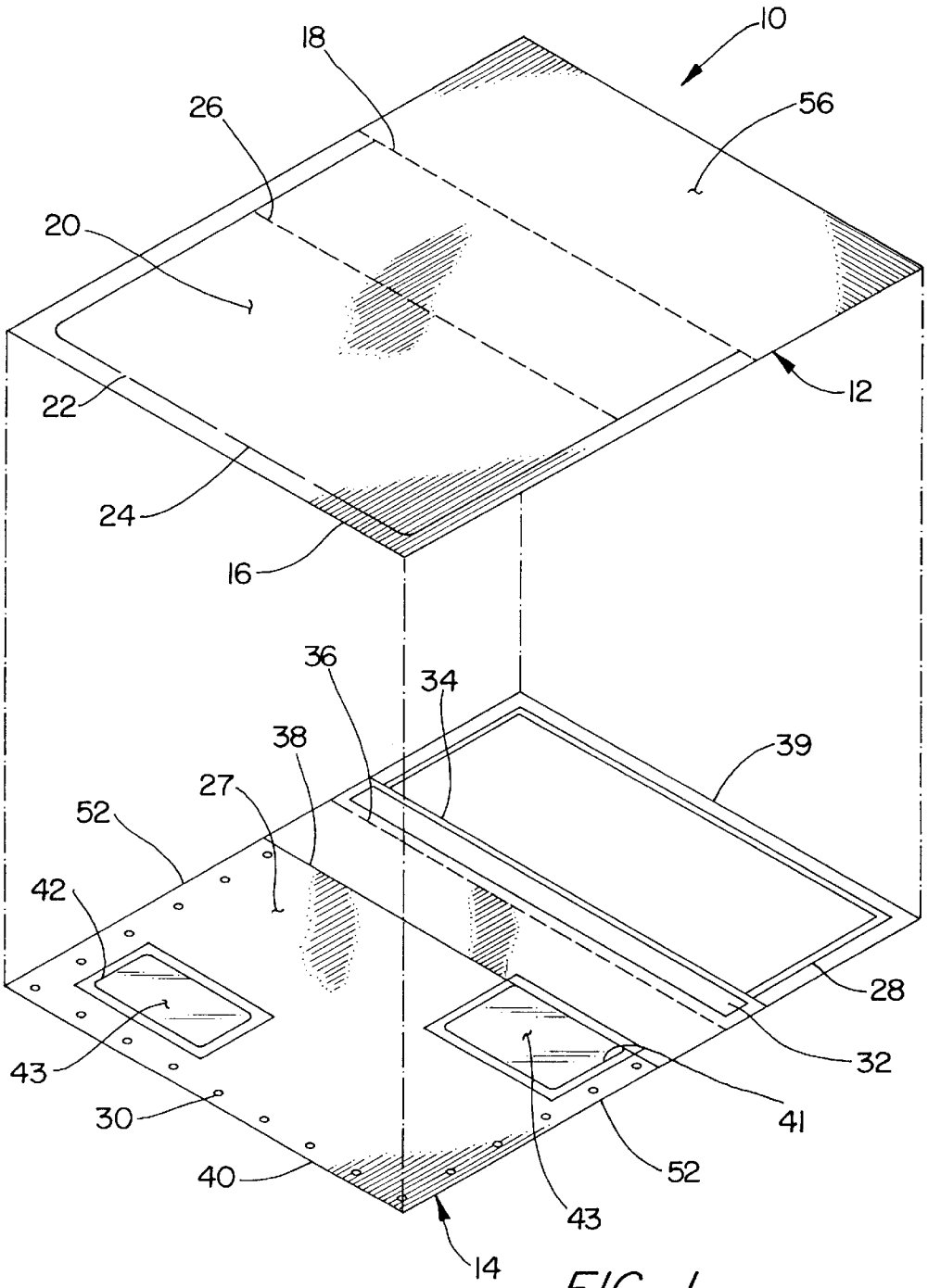
FIG. 1 is an exploded isometric view of a mailing form made in accordance with the present invention, showing the two paper sheets joined to make the form in an exploded relationship.

FIG. 1 is an exploded isometric view of a mailing form 10, which includes an upper sheet 12 and a lower sheet 14. It is to be understood herein that the words "upper" and "lower" imply directions which are arbitrarily chosen merely to establish a consistent way of describing the components and features of this form. Sheets 12 and 14 may be composed of any of a number of types of commercially available paper, or of certain thermoplastic materials and composites which are used as paper substitutes.

Mailing form 10 is particularly configured to facilitate subsequent processing through a typical non-impact printer, such as a laser printer or an ink jet printer commonly found in both small and large offices and computer rooms. Form 10 is designed so that all necessary information is to be printed on a single side of form 10; more specifically, all printing occurs on the upper side 56 of upper sheet 12. Where form 10 is to be used with a laser printer, the choice of materials and configurations is made to facilitate the movement of the form 10 through the hot pressure rolls of a non-impact printer fuser without damage to either the form or the fuser. While mailing form 10 is provided for printing in the shape of a single sheet of paper, which is preferably a standard size, such as 8.5 inches wide by 11 inches long, after printing it can be folded into an initial envelope containing a statement to be sent to a customer. After this initial envelope is received and opened, the customer can return a part of the form, together with a check, if required, in a return envelope also formed from a portion of mailing form 10.

Upper sheet 12 includes a removable "U" shaped outer strip 16, extending around a periphery of sheet 12 from a first perforated line 18 extending entirely across the sheet 12. Outer strip 16 is preferably joined to the adjacent inner flap 20 of upper sheet 12 by means of a number of ties 22 extending between slits 24 through the material of the sheet 12. A second perforated line 26 extends across inner flap 20.

Lower sheet 14 includes, on an upper (or inner) surface 27, adhesive features which are used in the process of joining the two sheets 12 and 14. A "U" shaped, pressure sensitive adhesive strip 28 extends around the periphery of an end of lower sheet 14, which is fastened to an end of upper sheet 12 opposite the end at which "U" shaped strip 16 is formed. A number of pressure sensitive adhesive dots 30 are formed in a "U" shaped pattern beneath to strip 16. Both adhesive strip 28 and adhesive dots 30 are preferably moved inward, away from the edges of the sheet 14, so that subsequent passage of the mailing form 10 through the fuser of a non-impact printer cannot squeeze adhesive material outward to or past the edges of form 10. The reason, of course, is that adhesive squeezed out from form 10 could otherwise become a damaging contaminant on the surface of the fuser rollers.

Lower sheet 14 also includes a number of features which are subsequently used to form envelopes. A re-moistenable adhesive layer 32 extends between a first scored line 34 and a perforated line 36. It should be understood that a scored line is weakened to facilitate folding at a preferred location and a perforated line includes voids to facilitate either folding or separation by tearing. Various well known form manufacturing processes can be used to form score lines and perforated lines as shown. For example, a perforated line can be formed by die cutting can be used to locate a fold as well as to locate a line of separation. Lower sheet 14 also includes a second scored line 38 extending transversely across the sheet 14 midway between a first end 39 and a second end 40 of lower sheet 14. Lower sheet 14 also includes a first aperture 41 and a second aperture 42, each of which is covered by a transparent sheet 43, fastened in place using a permanent adhesive. Each transparent sheet 43 is preferably composed of a heat resistant material, such as cellulose, which will not suffer excessive dimensional changes and wrinkling as mailing form 10 is subsequently passed through the hot fuser rolls of a typical non-impact printer.

Figure 2:
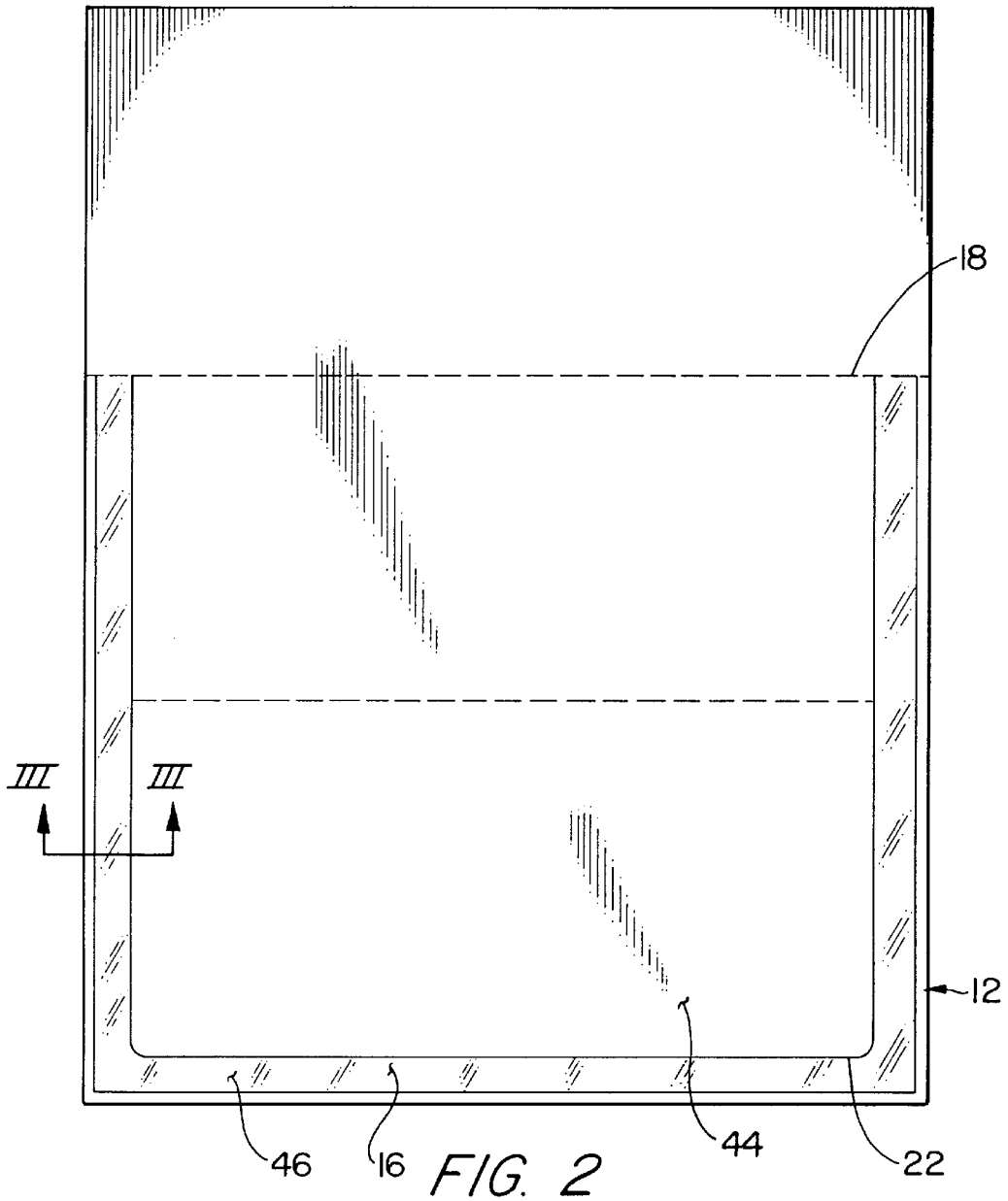
FIG. 2 is an underneath plan view of the upper paper sheet of the mailing form of FIG. 1.

FIG. 2 is an underneath plan view of upper sheet 12, showing the under (inner) surface 44 thereof. A reinforcing coating 46 is applied to the inner surface of "U" shaped outer strip 16 to facilitate the removal of strip 16, as a single piece, as described hereafter.

Figure 3:
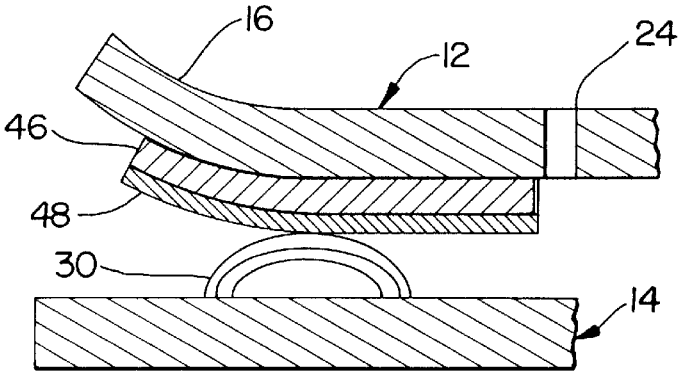
FIG. 3 is a cross-sectional elevational view of an outer flap portion of the upper paper sheet of FIG. 2, taken across lines III—III in FIG. 2, and being pulled away from an underlying lower paper sheet.

FIG. 3 is a cross-sectional elevation of outer strip 16, taken as indicated by section lines III—III in FIG. 2, as strip 16 is pulled away from underlying lower sheet 14. Reinforcing coating 46 is preferably composed of a coatable substance, such as varnish, having chopped fibers suspended therein. The chopped fibers may individually be 1/16 to 3/16 inch long and may be, for example, made from either fiberglass or from a natural material, such as cotton. An advantage of using a natural material, such as cotton, is that the biodegradability of the product after its disposal is enhanced. In general, various types of natural and synthetic fibers typically used in the production of textiles may be chopped to length for use as the filler. To speed the production of mailing form 10, the varnish used in reinforcing coating 46 is preferably of a type which is cured or "set" by means of the application of ultraviolet light. Further, by suspending the chopped fibers in the varnish, the additional steps of applying the fibers to the coated varnish after it is spread on the sheet is eliminated. The reinforcing coating 46 may be used to reinforce any portion of a sheet of paper, such as binder holes, as well as used to reinforce a removable portion, such as strip 16.

In the assembly of upper sheet 12 and lower sheet 14 to form mailing form 10, strip 16 is brought together with adhesive dots 30. After the subsequent printing process, strip 16 is removed and discarded. To facilitate separation of strip 16 from adhesive dots 30 at this point, a silicon release coating 48 is preferably coated on the exposed surface of reinforcing coating 46 during the production of upper sheet 12.

Referring again to FIG. 1, mailing form 10 is formed by aligning upper sheet 12 with lower sheet 14 and by pressing these sheets together. Pressure sensitive adhesive strip 28 holds sheets 12 and 14 together along first end 39 and partly along both longitudinal sides 52, while adhesive dots 30 hold sheets 12 and 14 together along second end 40 and partly along both sides 52. In this way, the sheets 12 and 14 are held together for processing through a non-impact printer. After this assembly process, the form 10 is ready for the printing of information on upper surface 56.

Figure 4:
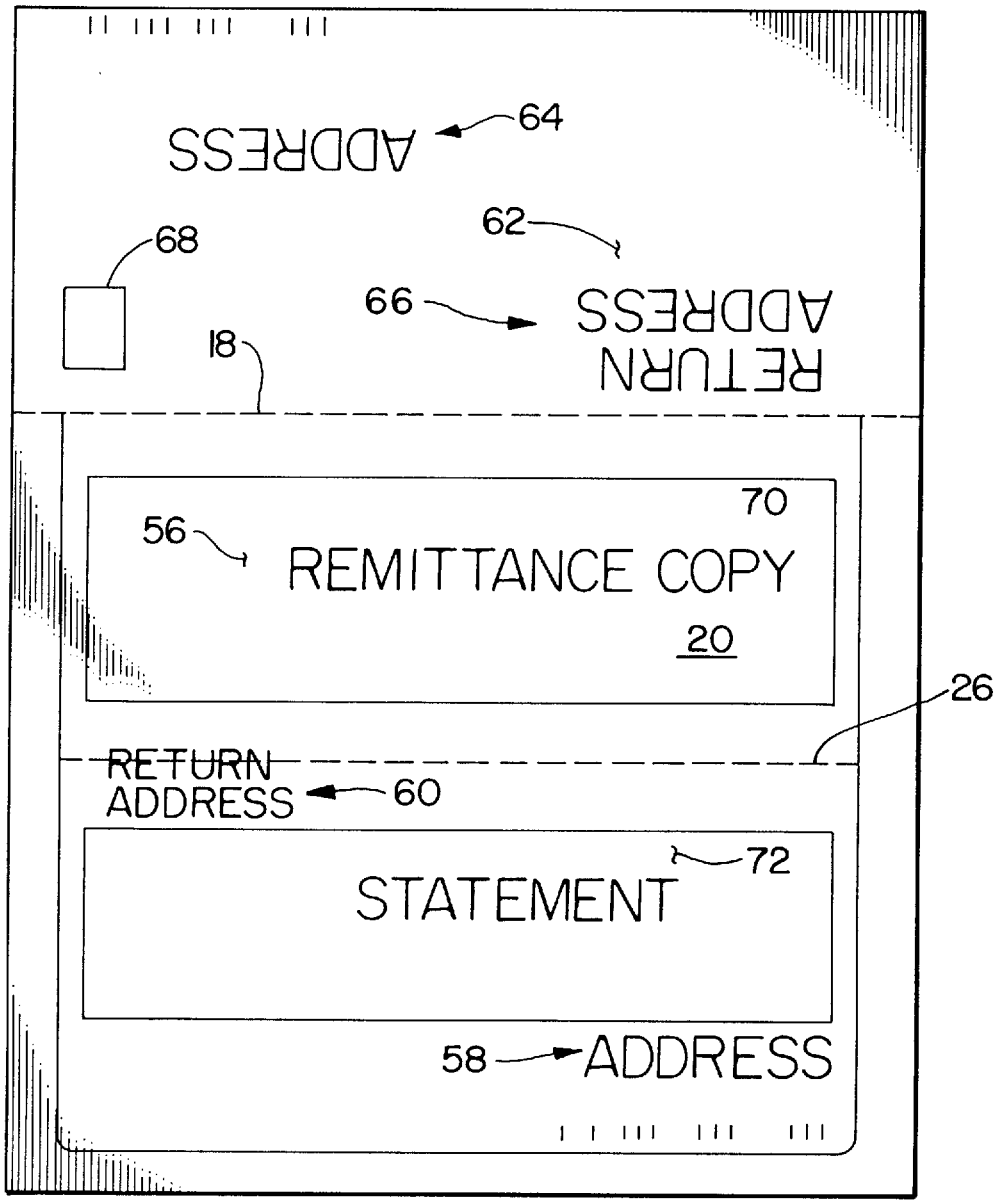
FIG. 4 is a plan view of the mailing form of FIG. 1 after a printing step.

FIG. 4 is a plan view of mailing form 10 after exemplary information is printed on upper surface 56. This information includes address and return address information for both an initial envelope configuration, in which form 10 is mailed to the customer, and for a return envelope configuration, in which the customer is expected to return a remittance portion of the form 10, together with additional material, if necessary, such as a check. Specifically, the address of the customer (or other individual or organization to which form 10 is initially sent) is printed in a first address field 58, and the return address of the organization initially sending the form is printed in a first return address field 60.

An end portion 62 of mailing form 10 is eventually used as a return envelope. Thus, the address of the organization expecting to receive the return envelope is printed in the second address field 64, and the address of the customer is printed in second return address field 66. Other envelope information, such as a stamp locating graphic 68, may also be printed. The envelope information on portion 62 is preferably printed in an inverted orientation relative to the other information printed on mailing form 10. In order to expedite the handling of materials through the postal system, a POSTNET bar code may be printed within each address field 58 and 64.

The information to be sent to the customer by means of mailing form 10 is printed on inner flap 20, which is divided into a first flap portion 70 and a second flap portion 72 by perforated line 26. All of first flap portion 70 can be used for such information. The envelope addressing information contained in fields 58 and 60 are arranged to align with apertures 41 and 42 following the folding steps described hereafter with respect to FIGS. 5 and 6. Therefore, the remaining area of second flap portion 72 can be used for informational content, which will be exposed only after the first envelope to be made using form 10 is opened. For example, the informational content of a statement may be printed on second flap portion 72, while a remittance copy to be returned by the customer may be printed on first flap portion 70.

Figure 5:
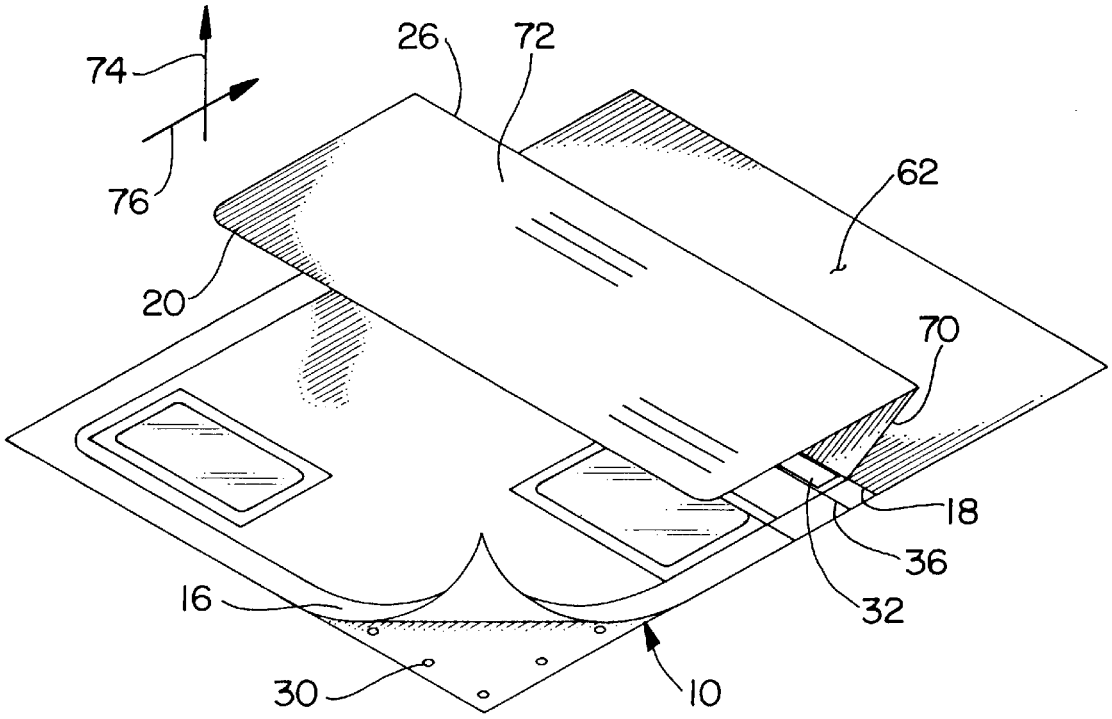
FIG. 5 is an isometric view of the mailing form of FIG. 1 during a first folding step, which occurs after the printing step.
Figure 6:
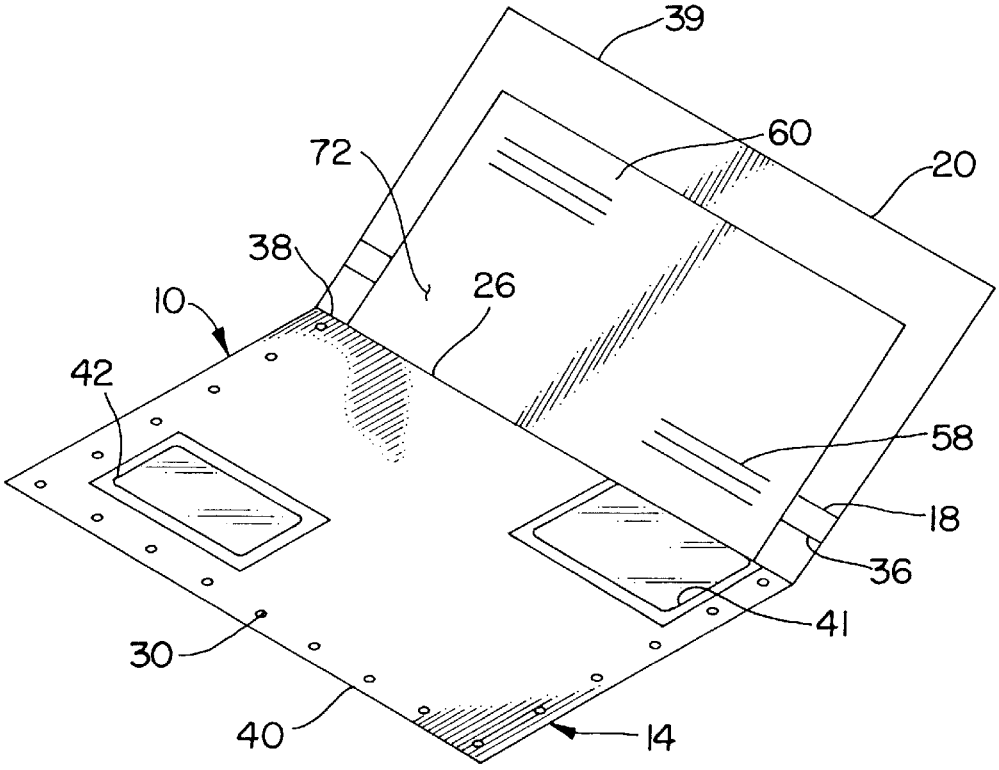
FIG. 6 is an isometric view of the mailing form of FIG. 1 during a second folding step, which occurs after the first folding step of FIG. 5.

Referring to FIGS. 5 and 6, outer strip 16 holds inner flap 20 in place and maintains a cover over adhesive dots 30 as mailing form 10 is fed through the printer during the printing process. After the printing process, inner flap 20 is pulled away from lower sheet 14, as ties 22 are torn apart, and outer strip 16 is separated and removed from the remainder of form 10. Reinforcing coating 46 facilitates the removal of outer strip 16 as a single piece, and the silicone release agent applied to the exposed surface of coating 46 allows strip 16 to be easily pulled away from adhesive dots 30, which are left in a condition ready for reuse. After outer strip 16 is removed, it is discarded.

More specifically, FIG. 5 shows an isometric view of mailing form 10 during the performance of a first folding step after the printing operation. First, inner flap 20 is released and folded along lines 18 and 26. Specifically, inner flap 20 is folded upward, in the direction of arrow 74, and longitudinally, in the direction of arrow 76, with bending occurring along perforated lines 18 and 26. After this folding step is completed, second flap portion 72 is upwardly exposed, while first flap portion 70 (shown in FIG. 4) is folded downward against end portion 62. Thereafter, outer strip 16 is removed, and adhesive dots 30 are upwardly exposed.

FIG. 6 shows an isometric view of mailing form 10 during the performance of a second folding step, which occurs after the first folding step of FIG. 5 and removal of outer strip 16. The combination of portion 62 and folded portions 70 and 72 and that portion of lower sheet 14 against which portions 70 and 72 are folded are folded along scored line 38 to enclose inner flap 20 as the ends 39 and 40 of lower sheet 14 are brought together. When this folding step is completed, form 10 is closed, and sealing occurs as pressure sensitive adhesive dots 30 are compressed against end portion 62. As noted above, address field 58 is exposed through aperture 41 and return address field 60 is exposed through aperture 42. At this point, mailing form 10 is converted into an envelope, which after the application of postage, is ready for mailing to the customer.

Figure 7:
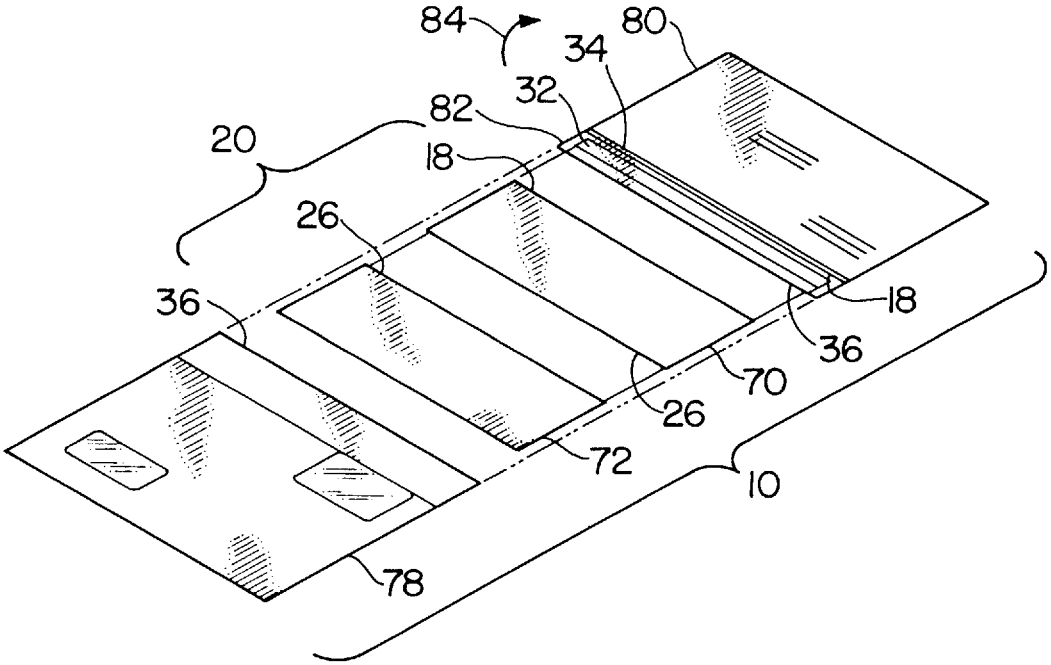
FIG. 7 is an isometric view of the mailing form of FIG. 1 after receipt, opening, and separation.

Referring now to FIG. 7, after the customer receives form 10 as folded for mailing, the customer first opens the envelope by peeling upper sheet 12 down, thereby breaking the seal formed by adhesive dots 30. With the seal broken, form 10 is snapped or pulled apart, thereby causing perforations 36 to separate and free scrap portion 78, and inner flap 20 is exposed. Next, inner flap 20 is pulled back into an essentially flat, unfolded condition, fully exposing the information printed on both second flap portion 72 and first flap portion 70 (shown in FIG. 4). Next, inner flap 20 is detached from the remainder of form 10 along perforated line 18, and first flap portion 70 and second flap portion 72 are separated from one another along perforated line 26. Inner flap 20 thus forms two separated documents, one of which may be statement 70 and the other of which may be remittance portion 72 to be returned by the customer within a return envelope 80, along with other materials as required, such as a remittance check.

FIG. 7 thus shows an isometric view of the materials of mailing form 10 after they have been separated into components parts by the customer. For convenience in FIG. 7, the edges formed by tearing a sheet apart along a perforated line are given the same reference number as the perforated line. The width of the pocket formed in return envelope 80, as determined by the distance between the portions of adhesive coating 28 extending along longitudinal sides 52 (as shown in FIG. 1) is preferably greater than 6 inches, thereby permitting the insertion of an ordinary consumer check without folding. As shown in the preferred embodiment where the two sheets 12 and 14 are standard sizes, such as eight and one-half by eleven inches or A4 size, the internal width of envelope 80 approximates seven and one half inches, and in fact is made wider than remittance portion 72 so that it may also be inserted in envelope 80 without folding. The necessary materials are placed in return envelope 80, adhesive layer 32 is moistened, and flap portion 82 is folded in the direction of arrow 84 about scored line 34 to seal the return envelope.

A number of variations can be applied within the scope of the present invention. For example, as shown in FIG. 4, the information in second address field 64 and second return address field 68 is printed in an inverted relationship with respect to other information printed on the mailing form 10. This is done to allow both the initial envelope and the return envelope to open from the top, as most people are familiar with opening envelopes in this way. Alternately, the printed information may be oriented in a common direction if either the initial envelope or the return envelope is allowed to open from the bottom.

As shown in FIG. 7, sealing flap 82 of the return envelope 80 extends from the rear of this envelope, having been formed as a part of lower sheet 14 (shown in FIG. 1). Alternately, a sealing flap can be provided, extending from the front of the envelope, being formed as a part of upper sheet 12 (also shown in FIG. 1), at the expense of shortening first flap portion 70, reducing the space available for printed information.

Compared to examples of the background art, the present invention combines a number of desirable features. The initial envelope, in which the statement is sent, the statement itself, and the return envelope are all made with portions of the mailing form itself, which is preferably the size and shape of an ordinary sheet of paper, i.e. 8.5 inches wide and 11 inches long. As explained above in reference to FIGS. 5 and 6, the mailing form can be easily folded into the initial envelope for mailing without the use of a folding machine.

Furthermore, all of the necessary printing can be accomplished with a single pass of the form through a non-impact printer, printing on one side of the paper. Therefore, any or all of the information printed on the form can be variable information, which is customized to the individual statement being sent. Thus, both the address of the customer and the address of the company, on both the initial envelope and on the return envelope, can be varied. Different post office boxes can be used to route the return envelopes according to the desires of the organization. A single organization can handle billing procedures for a number of different organizations. On the other hand, fixed data, such as opening instructions can be printed on any surface of mailing form 10 by another printing process.

While the invention has been described in its preferred form or embodiment with some degree of particularity, it is understood that this description has been given only by way of example and that numerous changes in the details of construction, fabrication and use, including the combination and arrangement of parts, may be made without departing from the spirit and scope of the invention.

What is claimed is:

1. A method for making a form including an envelope in which materials are sent and a return envelope, said method comprising the steps of:

defining a first portion, an outer flap and an inner flat in a first sheet;

separating said inner and outer flaps with a first perforated line;

forming a first transverse folding line midway between first and second ends of a second sheet;

applying an adhesive layer to said second end of said second sheet;

laying said first sheet over said second sheet with said outer flap extending to said second end of said second sheet;

permanently bonding said first end of said second sheet and said first sheet portion;

temporarily bonding said second end of said second sheet and said outer flap;

printing information on an outward facing surface of said first sheet;

removing said outer flap from said inner flap and from said second end of said second sheet, said adhesive layer remaining with said second end as said outer flap is removed;

folding said second sheet along said first transverse folding line, enclosing said inner flap; and, sealing said second sheet around said inner flap with said adhesive layer.

2. The method of claim 1, comprising the steps of:

removing a first portion of said second sheet at least prior to said laying step, forming an address aperture; and, printing a first address field on said outward facing surface of said first sheet in a position visible through said address aperture after said folding step.

3. The method of claim 2, comprising in addition, after said removing step, the steps of:

folding a first portion of said inner flap against said first portion of said first sheet; and, folding a second portion of said inner flap, including said first address field, along a second transverse line against said first portion of said inner flap.

4. The method of claim 3, comprising the steps of:

removing a second portion of said second sheet at least prior to said laying step, forming a return address aperture; and, printing a second address field on said outward facing surface of said first sheet in a position visible through said return address aperture after said folding step.

5. The method of claim 4, wherein said printing step comprises printing third and fourth address fields on an upper surface of said first portion of said first sheet for a further address and a further return address respectively.

6. A method for using a preassembled, at least partially preprinted multipart business form, said preassembled business form having:

upper and lower sheets, having interior sides facing one another and having first and second ends;

the lower sheet including a first fold line between the first and second ends thereof and a tear line between the fold line and the first end thereof;

the upper sheet having a top portion and a bottom portion the bottom portion having an inner flap and an outer strip peripheral to the inner flap except at a junction of said inner flap and the top portion, the inner flap further including a second fold line parallel to the junction; and, the top portion being permanently affixed to the lower sheet by a peripheral strip of a first adhesive and the outer strip being removably affixed to the lower sheet by a second adhesive, said method for assembling and using said business form comprising the steps of:

separating said inner flap from said outer strip;

folding said inner flap over said top portion at said junction;

folding said inner flap over itself at said second fold line;

removing said outer strip; and, folding said lower sheet at said first fold line.

7. The method of claim 6, comprising the step of exposing said second adhesive when removing said outer strip.

8. The method of claim 7, wherein said folding step comprises the steps of:

aligning said first ends of said upper and lower sheets with said second end of said lower sheets; and, applying pressure in an area above said exposed second adhesive, sealing said folded business form.

9. The method of claim 8, wherein said preassembled multipart form has a third fold line and said method comprises the step of implementing said folding steps so that said inner flap is positioned above an the area of said lower sheet between said third fold line and said first end of said lower sheet.

10. The method of claim 6, wherein said preassembled multipart form has a third fold line and said method comprises the step of implementing said folding steps so that said inner flap is positioned above an the area of said lower sheet between said third fold line and said first end of said lower sheet.

11. The method of claim 6, further comprising the step of printing an address on outward facing side of said upper sheet prior to said separating step.

12. The method of claim 11, comprising the step of exposing said second adhesive when removing said outer strip.

13. The method of claim 12, wherein said folding step comprises the steps of:

aligning said first ends of said upper and lower sheets with said second end of said lower sheet; and, applying pressure in an area above said exposed second adhesive, sealing said folded business form.

14. The method of claim 13, wherein said preassembled multipart form has a third fold line and said method comprises the step of implementing said folding steps so that said inner flap is positioned above an the area of said lower sheet between said third fold line and said first end of said lower sheet.

* * * * *